US006834433B1

(12) United States Patent
Dingus

(10) Patent No.: US 6,834,433 B1
(45) Date of Patent: Dec. 28, 2004

(54) CLOTH CUTTING DEVICE

(76) Inventor: Deborah Dingus, 24131 Douglas Dr., Plainfield, IL (US) 60544

( * ) Notice: Subject to any disclaimer, the term of this patent is extended or adjusted under 35 U.S.C. 154(b) by 0 days.

(21) Appl. No.: 10/457,741

(22) Filed: Jun. 9, 2003

(51) Int. Cl.[7] ..... B26B 25/00

(52) U.S. Cl. ..... 30/300; 408/101; 408/102; 408/137; 408/204

(58) Field of Search ..... 30/300, 310, 435, 30/436; 83/684, 631, 621; 408/101, 102, 137, 204

(56) References Cited

U.S. PATENT DOCUMENTS 1,131,582 A * 3/1915 Walsh ..... 30/445
1,590,994 A * 6/1926 Misener ..... 408/204
1,614,691 A * 1/1927 Rottler ..... 408/132
3,786,564 A * 1/1974 Acheson ..... 30/124
5,292,210 A * 3/1994 Nowick ..... 408/67
5,860,217 A * 1/1999 Braun ..... 30/300

* cited by examiner

*Primary Examiner*—Douglas D Watts
(74) *Attorney, Agent, or Firm*—Goldstein Law Offices P.L.

(57) ABSTRACT

A cloth cutting device used to cut perfect circular pieces from a piece of cloth. The cloth cutting device is positioned over the cloth and utilized in incising a perfect circular piece from the cloth. The device has a base support assembly that maintains the cutting device in a stationary position on the cloth to be cut, a cutting blade enclosed in a housing assembly, a rotateable handle, and a shaft interconnected between the housing assembly and the handle. Rotation of the handle causes the shaft to rotate, effectuating downward movement of the blade onto and into the cloth.

10 Claims, 4 Drawing Sheets

CLOTH CUTTING DEVICE

BACKGROUND OF THE INVENTION

The invention relates to a cloth cutting device. More particularly, the invention is a cutting device that cuts perfect circles from pieces of cloth.

Sewing is a craft enjoyed by many people as both a means of employment, as well as a hobby. The invention of the sewing machine has made the craft of sewing more accessible to a larger number of people. While sewing machines can perform numerous difficult and belaboring tasks, such as creating various types of hems and embroidering decorations and trimmings on fabrics, the ability of the machines are still limited. Many sewing patterns require circular pieces of material to be cut from a piece of fabric. Such a task is not possible with the use of a sewing machine.

Many cutting devices are known in the art, however most such cutting devices are only useful in cutting paper and similar thin materials. These devices are not designed for use with thicker fabric materials since they have a tendency to pull the material and cut unevenly.

Thus, there exists a need for a cutting device that is specially designed for cutting perfect circles from fabrics. Such a device is constructed to hold the fabric securely in place while a circular blade is pressed down on the fabric. The blade cuts through the fabric without damaging said fabric. Further, various sizes blades may be used with the device to produce circular pieces of different diameters.

U.S. Pat. No. 4,548,118 to Brosch discloses a rotary cutter for cutting holes of various sizes in sheet material, such as self-adhesive pads. U.S. Pat. No. 4,010,543 to Nusbaum discloses a hole cutting apparatus for making holes in material having a tacky nature. U.S. Pat. No. 5,079,843 to Shelton et al. discloses a hole cutter for ostomy adhesive wafers.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved cloth cutting device for cutting perfect circular pieces from the cloth. As such, the general purpose of the present invention, which will be described subsequently in greater detail, is to provide a new and improved cloth cutting device which has all the advantages of the prior art and none of the disadvantages.

To attain this, the present invention essentially comprises a cloth cutting device used to cut perfect circular pieces from a piece of cloth. The cloth cutting device is positioned over the cloth and utilized in incising a perfect circular piece from the cloth. The device has a base support assembly that maintains the cutting device in a stationary position on the cloth to be cut, a cutting blade enclosed in a housing assembly, a rotatable handle, and a shaft interconnected between the housing assembly and the handle. Rotation of the handle causes the shaft to rotate, effectuating downward movement of the blade onto and into the cloth.

It is an object of the invention to produce a cloth cutting device that cuts a perfect circle from a piece of fabric. Accordingly, the device has a circular blade that is pressed firmly against the fabric to produce a perfectly circular incision thereon.

It is a further object of the invention to produce a cloth cutting device that causes no damages to the fabric while cutting therefrom. Accordingly, the device is equipped with a base support assembly that securely holds the fabric in place while the blade is rotated downward. Thus, the fabric is not pulled or inadvertently torn.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
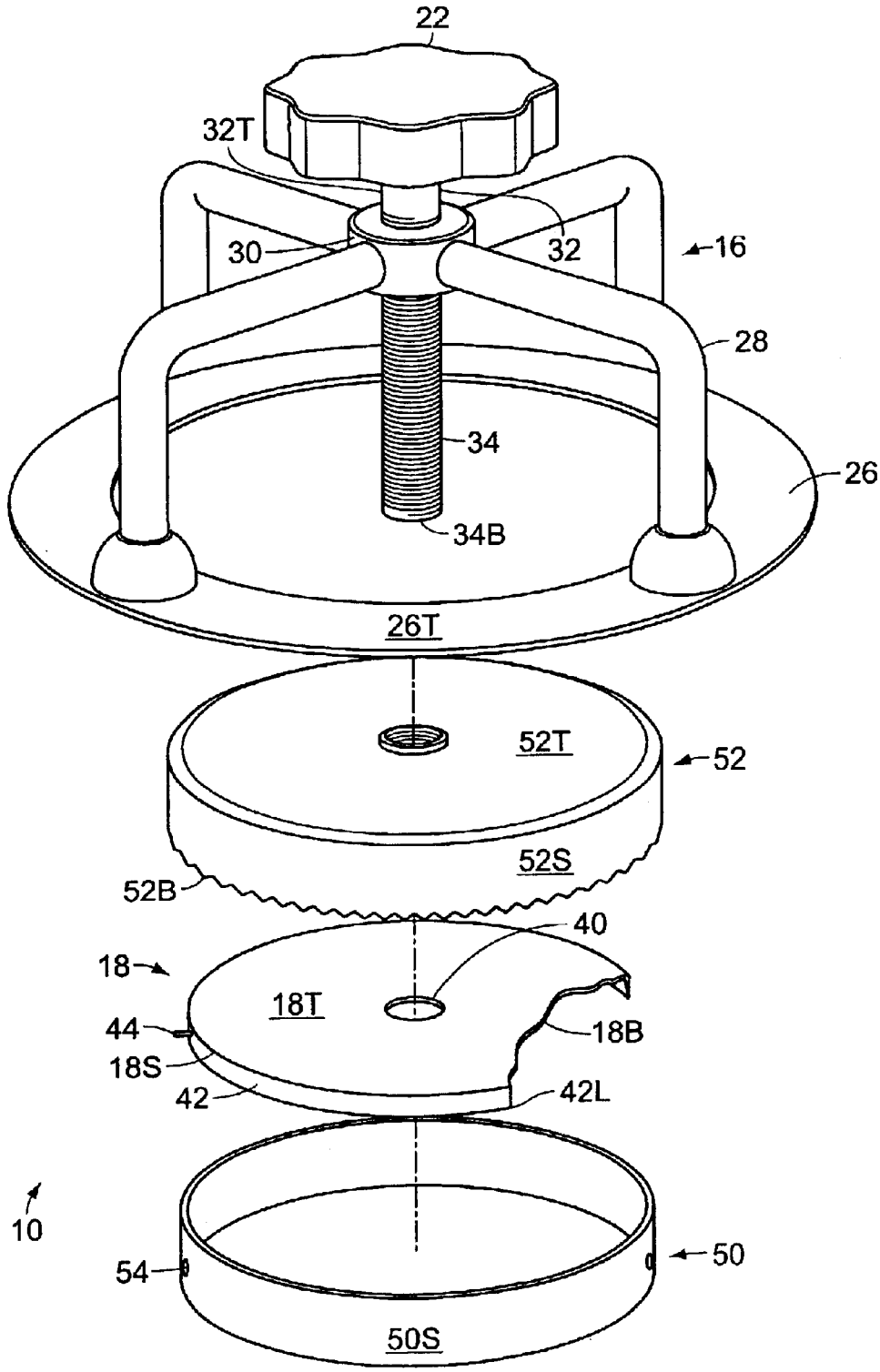
FIG. 1 is an exploded view of the cloth cutting device.

10 cloth cutting device
12 cloth
16 base support assembly
18 cutting blade
18T blade top surface
18B blade bottom surface
18S blade side edge
20 housing assembly
22 handle
24 shaft
26 circular ring
26T ring top surface
26B ring bottom surface
28 projecting leg
30 band
32 shaft top portion
32T shaft top end
34 shaft bottom portion
34B shaft bottom end
40 blade threaded opening
42 blade lip
42L blade lip lower edge
44 blade tab
50 housing interior shell
50B housing interior shell bottom edge
50S housing interior shell side
52 housing outer shell
52T housing outer shell top surface
52S housing outer shell side
52B housing outer shell bottom edge
52C housing outer shell center opening

54 lower shell side slot
58 stopper

DETAILED DESCRIPTION OF THE PREFERRED EMBODIMENTS

Figure 2:
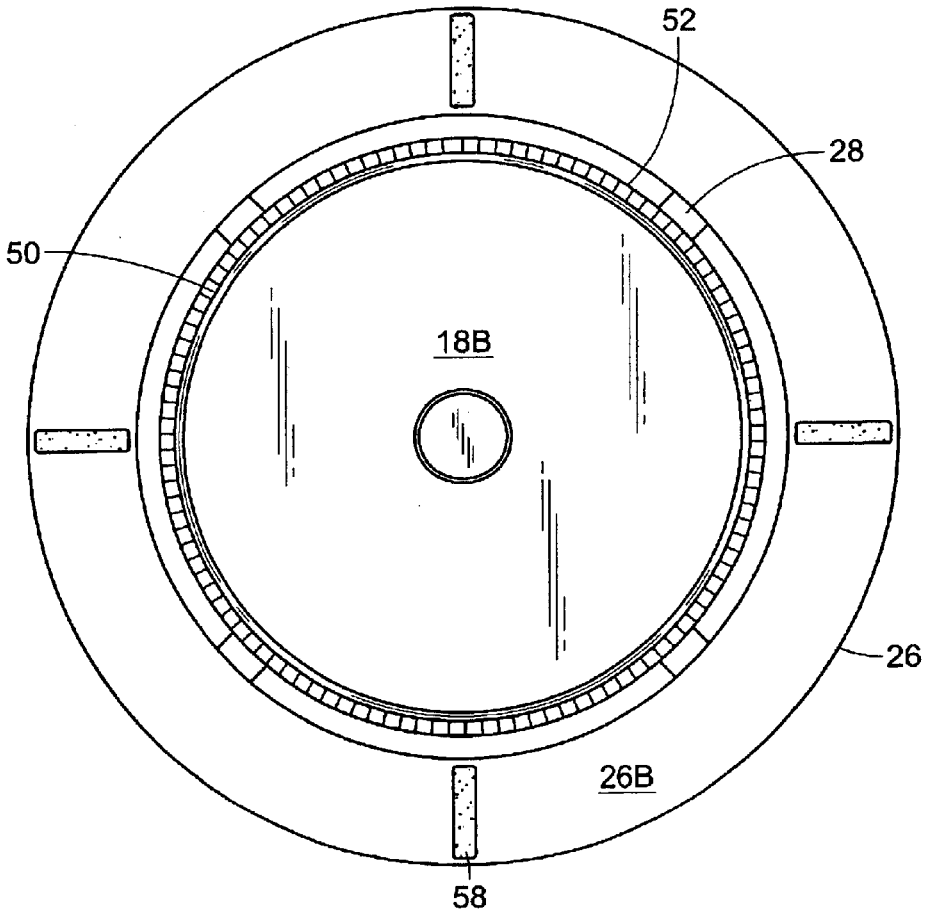
FIG. 2 is a bottom elevational view of the cloth cutting device.
Figure 3:
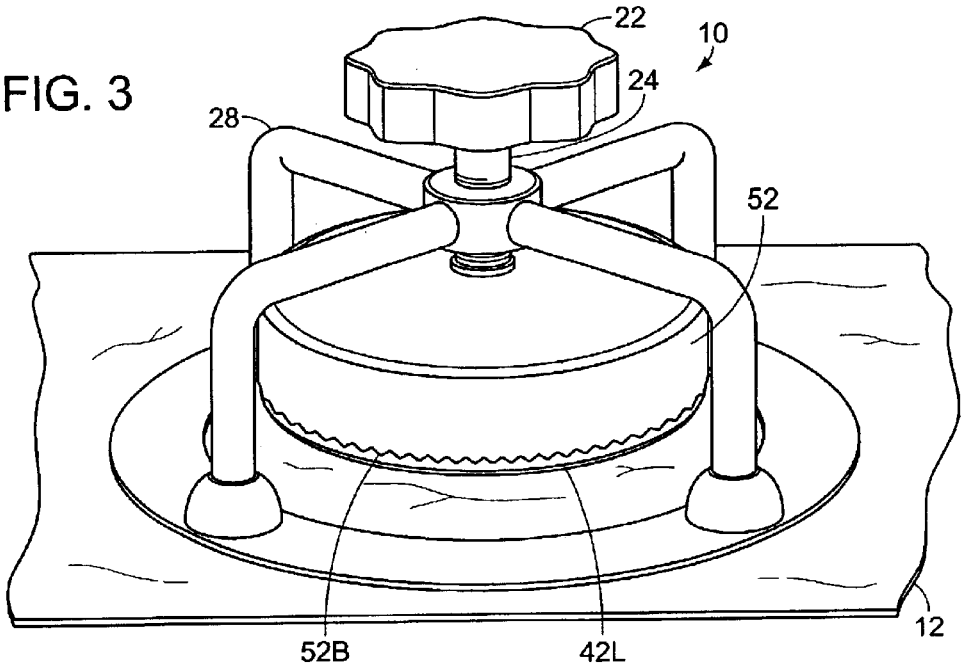
FIG. 3 is a diagrammatic perspective view of the cloth cutting device positioned over a piece of cloth.

FIG. 1–3 illustrate a cloth cutting device 10 used to cut perfect circular pieces from a piece of cloth. The cloth cutting device 10 is positioned over the cloth 12 and utilized in incising a perfect circular piece from the cloth 12. The device 10 essentially comprises a base support assembly 16 that maintains the cutting device 10 in a stationary position on the cloth 12 to be cut, a cutting blade 18 enclosed in a housing assembly 20, a rotateable handle 22, and a shaft 24 interconnected between the housing assembly 20 and the handle 22. Thus, rotation of the handle 22 causes the shaft 24 to rotate, thereby effectuating downward movement of the blade 18 onto and into the cloth 12.

Figure 5:
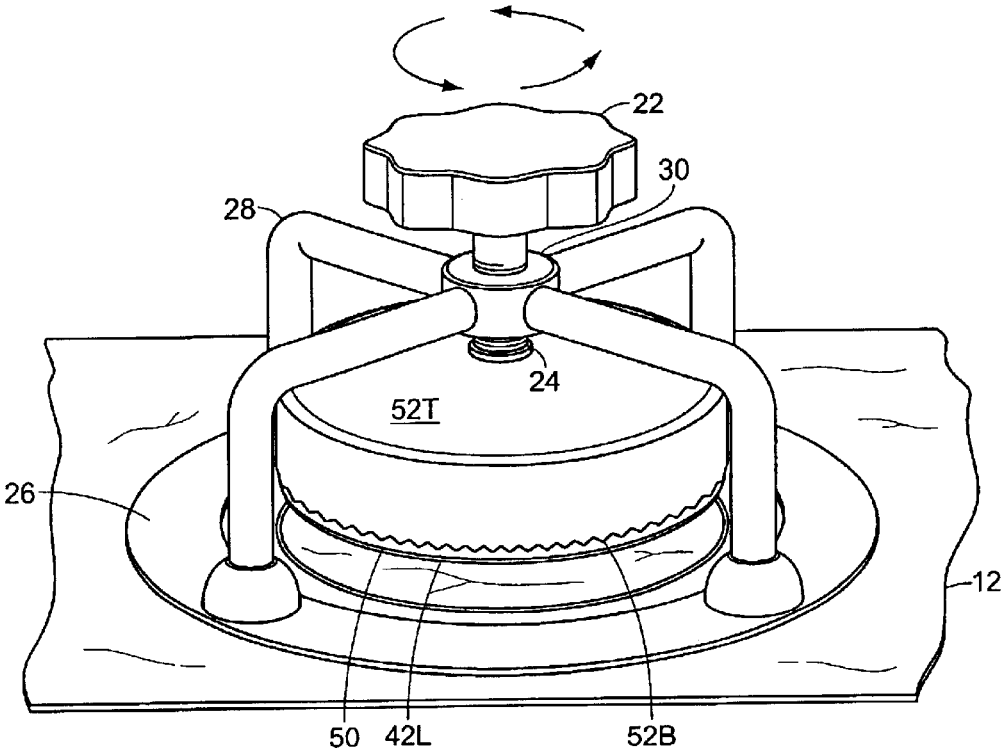
FIG. 5 is a diagrammatic perspective view of the cloth cutting device positioned over a piece of cloth, illustrating counterclockwise rotation of the handle, shaft and blade upward away from the cloth.

Referring to FIG. 5, the blade 18 is a metal disk having a top surface 18T, a bottom surface 18B, a side edge 18S, and an opening 40 in the center thereof. The opening 40 is sized to accommodate the shaft 24, as will be described in greater detail hereinafter. A lip 40 projects downward from the bottom surface 18B around the circumference of the blade 18. The lip 42 has a lower edge 42L, said lower edge 42L honed to form a sharp cutting blade for cutting clothes 12. The blade 18 further has a plurality of metal tabs 44 that extend outward substantially perpendicular from the blade side edge 18S. The blade 18 preferably has four such tabs 44, said tabs 44 being spaced ninety (90°) degrees apart from each other. The tabs 44 are mateable with the housing assembly 20, as will be described hereinafter.

The blade 18 is housed in a housing assembly 20, said housing assembly 20 comprising an interior shell 50 and an outer shell 52. The blade 18 is positioned within the interior shell 50, and the outer shell 52 extends therearound. The outer shell 52 has a larger diameter than the interior shell 50 in order to fit completely and securely thereover. The interior shell 50 has a bottom edge 50B, such that when the blade 18 is positioned within the interior shell 50, the blade lip 42 extends downward past the shell bottom edge 50B, thereby enabling the blade lower edge 42L to be brought into direct contact with the cloth 12 to be cut while maintaining the blade 18 within the housing assembly 20.

A plurality of different sized blades 18 made be used with the cutting device 10, each blade 18 having a different diameter for cutting different sized circles from the piece of cloth 12.

The interior shell 50 further has a side 50S that extends upward from the shell bottom edge 50B and around the circumference of the shell 50, said side 50S having a plurality of recessed slots 54 therein. The shell 50 preferably has four (4) such slots 54, each slot 54 being spaced ninety (90°) degrees apart from each other. The blade tabs 44 are mateable with these slots 54. Upon mating the tabs 44 with the slots 54, the blade 18 is secured in place within the housing assembly 20, particularly within the interior shell 50. The blade 18 is secured to the shaft 24, as will be described in greater detail shortly, said attachment preventing the blade and the interior shell 50 from being unintentionally removed from the cutting device 10.

The outer shell 52 has a top surface 52T and a side 52S, said side 52S extending downward from the top surface 52T and around the circumference of the upper shell 52. The side 52S has a bottom edge 52B, said bottom edge 52B being serrated. The serrations serve to hold the cloth 12 in place while being cut by the blade 18. When the outer shell 52 is in place over the interior shell 50, the outer shell side 52S extends downward over the interior shell side 50S, and the outer shell bottom edge 52B is at the substantially the same height as the interior shell bottom edge 50B.

The shaft 24 has a top portion 32, having a top end 32T, and a bottom portion 34, having a bottom end 34B. The bottom portion 34 of the shaft 24 is threaded in order to allow said bottom portion 34 to be selectively mated with the housing assembly 20 through the outer shell threaded opening 52C. The rotateable handle 22 is secured to the shaft top end 32T, and shaft bottom end 34B is fixedly secured to the blade 18 at the blade opening 40. The handle 22 serves to push and rotate the shaft 24 and the housing assembly 20 downward towards the cloth 12 or upward away from the cloth 12.

The base support assembly 16 comprises a circular ring 26 and a plurality of projecting legs 28 extending upward therefrom. The legs 28 extend around the housing 20 in the center of the cutting device 10. Each leg 28 is joined to the shaft top portion 32 at a band 30, said band 30 extending around said shaft top portion 32. The circular ring 26 is larger than the size of the cloth to be cut, thereby creating a boundary around the subject cloth 12. The blade 18 and housing assembly 20 are positioned within the ring 26, thereby causing the blade 18 to cut into the cloth 12 contained within the circular ring 26. The ring 26 has a top surface 26T and a bottom surface 26B, whereby when the cutting device 10 is positioned over the piece of cloth 12 to be cut, the ring bottom surface 26B is pressed against the cloth 12. Referring to FIG. 5, a plurality of rubber stoppers 58 are secured to the ring bottom surface 26B, said stoppers 58 providing a degree of friction between the cutting device 10 and the cloth 12. This friction reduces the amount of movement of the cutting device 10, thereby preventing the cutting of imperfect circles.

Figure 4:
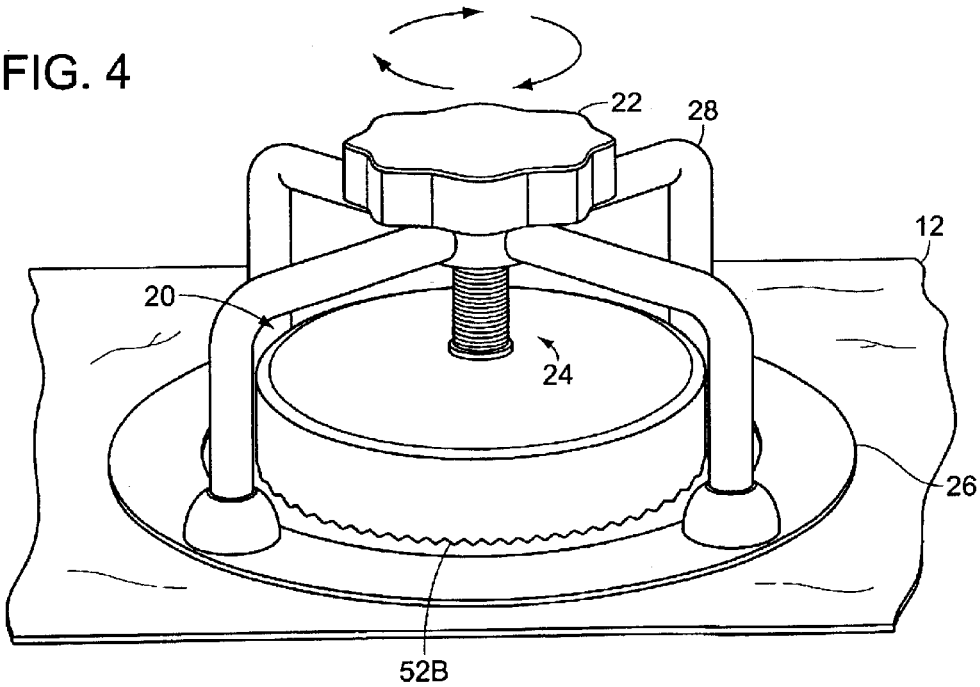
FIG. 4 is a diagrammatic perspective view of the cloth cutting device positioned over a piece of cloth, illustrating clockwise rotation of the handle, shaft and blade downward into the cloth.

In use, one of the blades 18 is chosen according to the size of the cloth 12 to be cut. The blade 18 is then positioned within the interior shell 50 by mating the blade tabs 44 with the shell slots 54. The outer shell 52 is then attached to the shaft 18 by threading the shaft bottom portion 34 through the outer shell opening 52C. Once the outer shell 52 is properly positioned on the shaft 18, the interior shell 50 and the blade 18 are then attached thereto by mating the shaft bottom end 34B with the blade opening 40. After being assembled, the cloth cutting device 10 is positioned over the piece of cloth 12 to be cut, as illustrated in FIG. 1. Downward pressure is applied to the handle 22, thereby pressing the housing assembly 20 and the blade 18 downward onto the cloth. The honed lower edge 42L of the blade 18 is brought into contact with the cloth 12, causing an incision therein, as illustrated in FIG. 4. While maintaining downward pressure on the handle 22, the handle 22 is also rotated in a clockwise direction. The rotation causes the housing assembly to moved downward towards the cloth 12. The serrated bottom edge 52B of the outer shell 52B catches the cloth 12, and prevents said cloth 12 from moving while the blade 18 is rotated thereon. This movement effectuates a clean and concise incision in the cloth 12.

Figure 6:
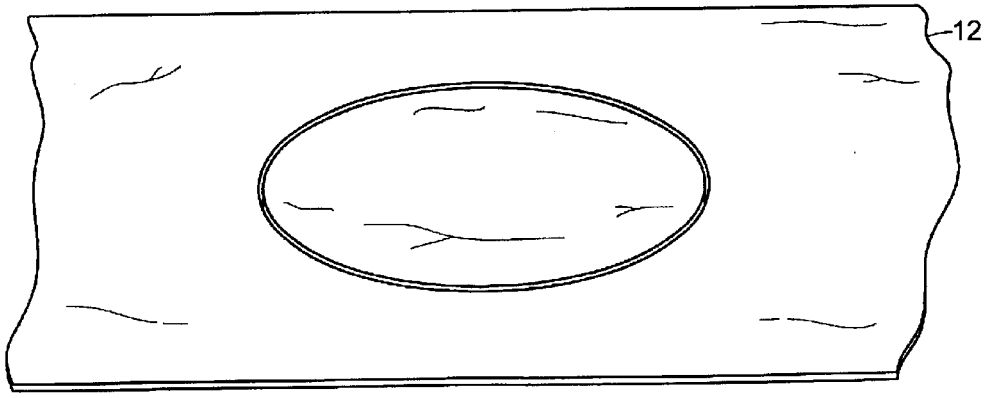
FIG. 6 is a diagrammatic perspective view of the cloth, illustrating the cutting of a circle therein.

Once the cloth 12 is completely cut, the pressure on the handle 22 is released and the handle 22 is then rotated in a counterclockwise direction in order to raise the blade 18 and housing assembly 20 from the cloth 12, as illustrated in FIG. 5. Referring to FIG. 6, the cutting device 10 is then removed from the cloth 12 and a perfect circular piece of cloth 12 removed therefrom.

In conclusion, herein is presented a cloth cutting device for cutting perfect circles from a piece of cloth. The invention is illustrated by example in the drawing figures, and throughout the written description. It should be understood that numerous variations are possible, while adhering to the inventive concept. Such variations are contemplated as being a part of the present invention.

What is claimed is:

1. A cloth cutting device used to cut circular pieces from a section of cloth, comprising:

a cutting blade, the blade having a top surface, a bottom surface, a side edge, and a threaded opening in the center thereof, the blade further having a lip extending downward from the bottom surface side edge, said lip having a honed lower edge;

a housing assembly for housing the cutting blade;

a rotateable handle;

a shaft, the shaft being interconnected between the housing assembly, the blade threaded opening and the handle, whereby rotation of the handle causes the shaft to rotate downward effectuating downward movement of the housing assembly and the blade into the cloth; and a base support assembly, the support assembly extending downward from the shaft onto the cloth to be cut, said assembly maintaining the cutting device in a stationary position on the cloth to be cut.

2. The cloth cutting device as recited in claim 1, wherein the shaft comprises a top portion having a top end, and a bottom portion having a bottom end, said bottom portion being threaded, wherein the handle is secured to the shaft top end, the housing assembly is secured to the shaft bottom portion, and blade is secured to the shaft bottom end.

3. The cloth cutting device as recited in claim 1, wherein the housing assembly comprises an interior shell having a bottom edge and an outer shell, the blade resting within the interior shell and extending downward past the interior shell bottom edge, and the outer shell extending thereover, said outer shell having a larger diameter than the interior shell in order to fit completely and securely thereover.

4. The cloth cutting device as recited in claim 3, wherein the housing interior shell further comprises a side, said side extending upward from the shell bottom edge and around the circumference of the shell, wherein the side has a plurality of recessed slots therein, and wherein the blade further comprises a plurality of tabs extending outward substantially perpendicular from the blade side edge, wherein the blade tabs are selectively mateable with shell slots to secure the blade in place within the interior shell.

5. The cloth cutting device as recited in claim 3, wherein the housing outer shell comprises a top surface and a side, the side extending downward from the top surface and around the circumference of the upper shell, wherein the side has a serrated bottom edge, said serrations serving to hold the cloth in place while being cut by the blade.

6. The cloth cutting device as recited in claim 2, wherein the base support assembly comprises a circular ring and a plurality of projecting legs extending upward therefrom, wherein the legs extend around the housing in the center of the cutting device and each leg is joined to the shaft top portion at a band, said band extending around said shaft top portion.

7. The cloth cutting device as recited in claim 6, wherein the base support assembly circular ring has a larger circumference than the size of the cloth to be cut, thereby creating a boundary around the subject cloth.

8. The cloth cutting device as recited in claim 7, wherein the base support assembly ring has a top surface and a bottom surface, the bottom surface being pressed against the cloth when the cutting device is in place over the cloth, the bottom surface comprises a plurality of rubber stoppers secured thereto.

9. The cloth cutting device as recited in claim 8, further comprises a set of various sized blades, each blade having a different diameter for cutting different sized circles from the piece of cloth.

10. A method of cutting a circle from a piece of cloth using a cloth cutting device, the cutting device comprising a blade, a housing assembly, a shaft, and a handle, the blade having a plurality of tabs extending substantially perpendicular thereto, a lip extending downward from the blade, the lip having a honed lower edge, and the housing assembly having an outer shell and an interior shell, the interior shell having a side and slots cut from the side, and the shaft having a threaded bottom portion, and the outer shell having a threaded opening in the center thereof and a serrated bottom edge, comprising the steps of:

positioning the blade within the interior shell by mating the blade tabs with the shell slots;

attaching the outer shell to the shaft by threading the shaft bottom portion through the outer shell opening;

attaching the interior shell and the blade to the shaft by mating the shaft bottom end with the blade opening;

positioning the assembled cloth cutting device over the piece of cloth to be cut;

bringing the blade lip lower edge into contact with the cloth by applying downward pressure to the handle;

holding the cloth in place by rotating the handle to bring the serrated edge of the outer shell into contact with the cloth; and cutting the cloth with the blade by rotating the handle in a clockwise direction.

* * * * *